United States Patent [19]

Fierbaugh

[11] Patent Number: 4,987,958

[45] Date of Patent: Jan. 29, 1991

[54] CHIMNEY FIRE EXTINGUISHING APPARATUS

[76] Inventor: Charles A. Fierbaugh, 168 Midway Dr., Dunbar, W. Va. 25064

[21] Appl. No.: 390,978

[22] Filed: Aug. 7, 1989

[51] Int. Cl.[5] ..... A62C 37/12

[52] U.S. Cl. ..... 169/57; 169/65

[58] Field of Search ..... 169/9, 19, 23, 26, 54, 169/56, 57, 61, 65

[56] References Cited

U.S. PATENT DOCUMENTS

| | | | |
|---|---|---|---|
| 3,536,139 | 10/1970 | Berti . | |
| 4,026,465 | 5/1977 | Kenny | 169/60 X |
| 4,519,458 | 5/1985 | Kroeter | 169/65 |
| 4,532,996 | 8/1985 | Wilson et al. | 169/23 |
| 4,646,847 | 3/1987 | Calvin . | |
| 4,664,197 | 5/1987 | Leduc et al. | 169/57 |
| 4,718,498 | 1/1988 | Davios et al. . | |
| 4,736,801 | 4/1988 | Grewell . | |

*Primary Examiner*—Joseph F. Peters, Jr.
*Assistant Examiner*—Virna Lissi Mojica
*Attorney, Agent, or Firm*—Leon Gilden

[57] ABSTRACT

An apparatus is presented for reducing temperatures within a firebox to provide reduced temperatures within a firebox and accordingly eliminate combustion occurring within a flue assembly of the firebox. A solenoid apparatus is operative upon closure of a circuit effected by actuation of a bi-metallic strip in response to elevated flue temperatures. A pressurized water container directs extinguishing fluid, such as water, through a spray nozzle interiorly of the firebox to reduce temperatures within the firebox.

1 Claim, 3 Drawing Sheets

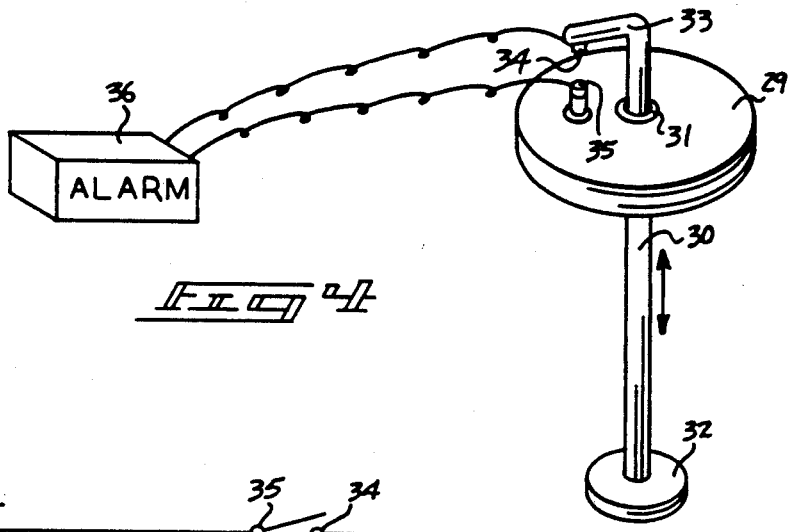
FIG 4
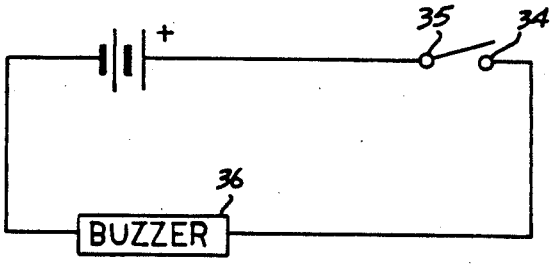
FIG 5
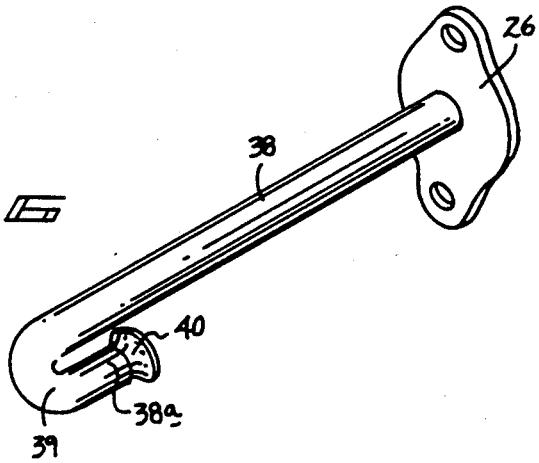
FIG 6
FIG 7
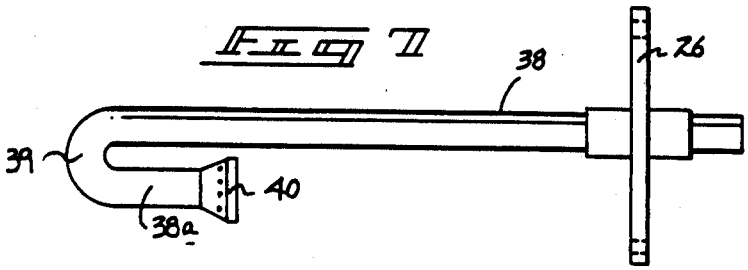

CHIMNEY FIRE EXTINGUISHING APPARATUS

BACKGROUND OF THE INVENTION

1. Field of the Invention

The field of invention relates to fire extinguishing apparatus, and more particularly pertains to a new and improved chimney fire extinguishing apparatus wherein the same utilizes a bi-metallic switch positioned within a flue assembly to actuate a temperature reduction spray apparatus positioned within a firebox organization.

2. Description of the Prior Art

The use of various fire extinguishing apparatus is well known in the prior art. The prior art has utilized various elaborate and extensive organizations to reduce hazardous effects of a chimney fire typically resulting from soot, cresote, and other element subject to fire within a flue assembly. Organizations of the prior art have typically required extensive modification of existing structure or have been of a relatively complex organization to resist their incorporation in contemporary usage. Examples of the prior art include U.S. Pat. No. 4,646,847 to Colvin setting forth a chimney liner extinguishing apparatus wherein the same includes an airflow restriction plate held in position until a fusable element is melted by effects of combustion within the flue, as opposed to the instant invention which merely reduces firebox temperatures to eliminate a chimney fire and accordingly does not require resetting of such a mechanical impediment and wherein the instant invention is readily reusable for subsequent situation fires.

U.S. Pat. No. 3,536,139 to Bertl provides a discharge assembly for use as a fire extinguisher in arrangement adjacent a container, such as a trash container, operative upon sensing of a particular elevated temperature situation.

U.S. Pat. No. 4,026,465 to Kenny provides a temperature sensitive actuator associated with a spring-loaded linkage, whereupon sensing of elevated temperature effects operation of a sprinkler system due to overcentering of the linkage.

U.S. Pat. No. 4,718,498 to Davios, et al., utilizes a flame-sensing device associated with a circuit to release a fire extinguishing fluid in response to the elevated temperature. The flame-sensing device includes a first spring when heated and a second spring to pull a contact in association with an electromagnet to actuate the fire extinguishing of a container and medium contained therewithin.

U.S. Pat. No. 4,736,801 to Grewell provides a fire extinguishing manifold for discharging water on a chimney fire positioned through the flue assembly of a chimney and secured by a flexible hose from an upper end of the chimney, wherein the hose is secured to a remotely positioned reservoir supply,, such as a tank truck, and the device is manually lowered within the chimney for use.

As such, it may be appreciated that there is a continuing need for a new and improved chimney fire extinguishing apparatus wherein the same addresses both the problem of ease of use and effectiveness in construction, and in this respect, the present invention substantially fulfills this need.

SUMMARY OF THE INVENTION

In view of the foregoing disadvantages inherent in the known types of chimney fire extinguishing apparatus now present in the prior art, the present invention provides a chimney fire extinguishing fire apparatus wherein the same utilizes a bi-metallic sensor probe positioned within a flue to actuate a remote reservoir to direct a cooling fluid interiorly of a firebox. As such, the general purpose of the present invention, which will be described subsequently in greater detail, is to provide a new and improved chimney fire extinguishing apparatus which has all the advantages of the prior art chimney fire extinguishing apparatus and none of the disadvantages.

To attain this, the present invention comprises a chimney fire extinguishing apparatus including a bi-metallic switch positioned within a flue of a furnace arrangement operatively associated to a solenoid. The solenoid is positioned within a conduit of a pressured reservoir container. Upon actuation of the solenoid by the bi-metallic switch sensing an elevated temperature situation, the solenoid directs fluid therethrough into a flexible hose connection and into a perforated tube to direct a cooling spray of fire extinguishing fluid, such as water, onto a fire to reduce temperatures and thereby eliminate a chimney fire. An audible alarm is optionally associated with the reservoir whereupon a dropping of the fluid level within the reservoir actuates an alarm indicating usage of the fluid and presence of a chimney fire. A modified nozzle includes a 180 degree reorientation of the cooling spray against an interior surface of a wall of the firebox to minimize potential for extinguishment of a flame within the firebox and reduce temperatures therewithin.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved chimney fire extinguishing apparatus which has all the advantages of the prior art chimney fire extinguishing apparatus and none of the disadvantages.

It is another object of the present invention to provide a new and improved chimney fire extinguishing apparatus which may be easily and efficiently manufactured and marketed.

It is a further object of the present invention to provide a new and improved chimney fire extinguishing apparatus which is of a durable and reliable construction.

An even further object of the present invention is to provide a new and improved chimney fire extinguishing apparatus which is susceptible of a low cost of manufacturre with regard to both materials and labor, and which accordingly is then susceptible of low prices of sale to the consuming public, thereby making such chimney fire extinguishing apparatus economically available to the buying public.

Still yet another object of the present invention is to provide a new and improved chimney fire extinguishing apparatus which provides in the apparatuses and methods of the prior art some of the advantages thereof, while simultaneously overcoming some of the disadvantages normally associated therewith.

Still another object of the present invention is to provide a new and improved chimney fire extinguishing apparatus wherein the same is operative upon sensing of elevated temperatures within a flue to direct a cooling fluid within a firebox assembly of a furnace arrangement.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an isometric illustration of an audible alarm utilized by the instant invention.

FIG. 5 is a schematic illustration of a typical electrical circuit utilized by the audible alarm, as illustrated in FIG. 4.

FIG. 6 is an isometric illustration of a modified nozzle arrangement as utilized by the instant invention.

FIG. 7 is a top orthographic view of the modified nozzle of FIG. 6.

DESCRIPTION OF THE PREFERRED EMBODIMENT

Figure 1:
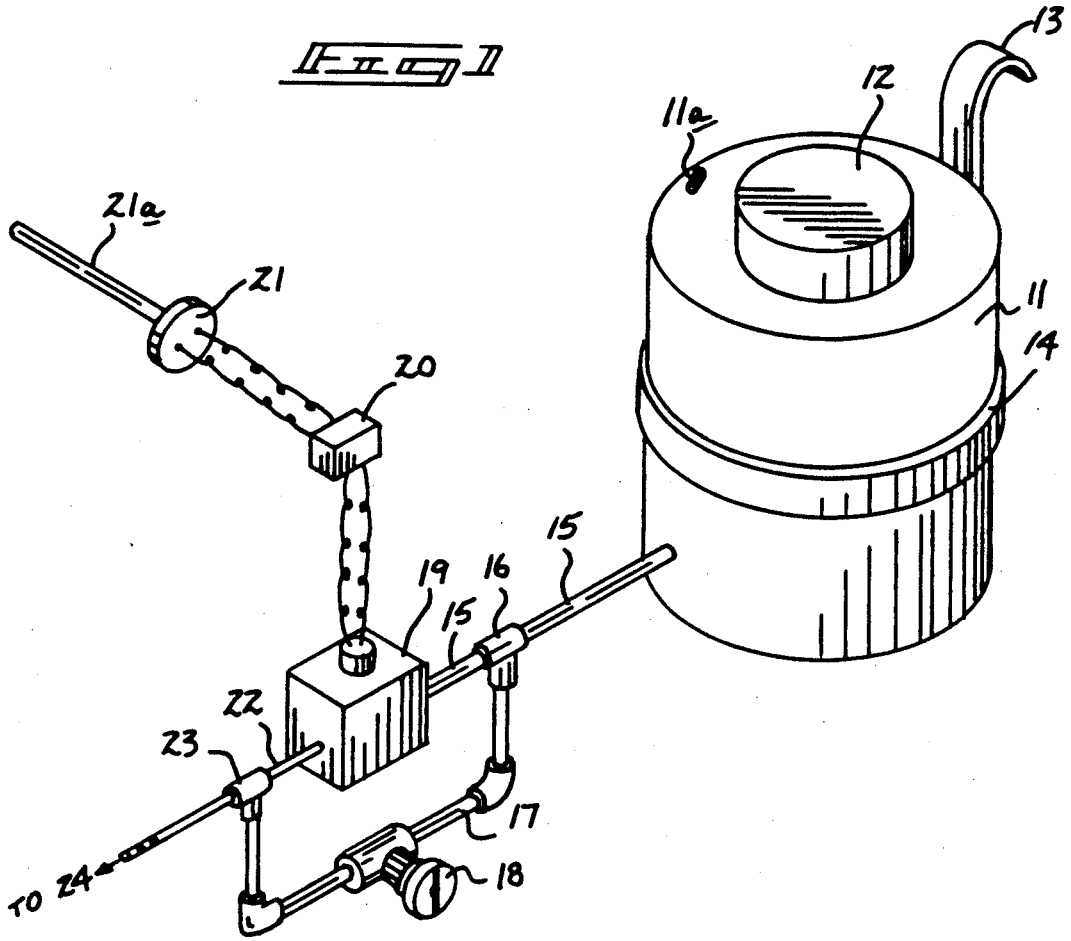
FIG. 1 is an isometric illustration of a first portion of the instant invention including the reservoir and valve structure.

With reference now to the drawings, and in particular to FIGS. 1 to 7 thereof, a new and improved chimney fire extinguishing apparatus embodying the principles and concepts of the present invention and generally designated by the reference numeral 10 will be described.

Figure 2:
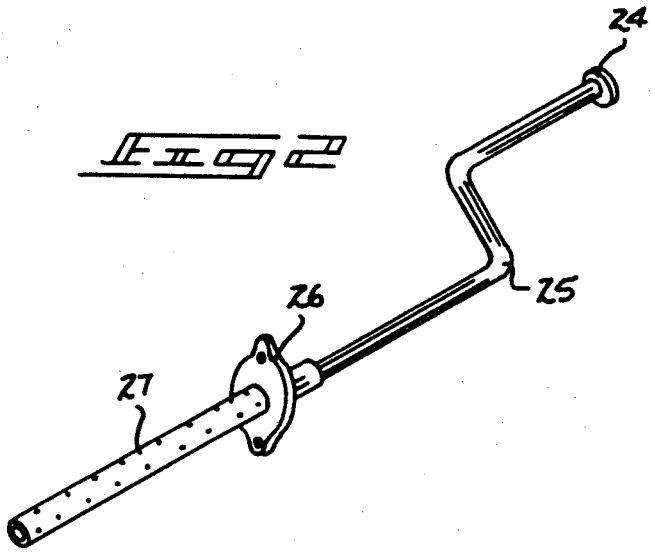
FIG. 2 is an isometric illustration of the flexible hose and perforated tube utilized by the instant invention positioned within a firebox.
Figure 3:
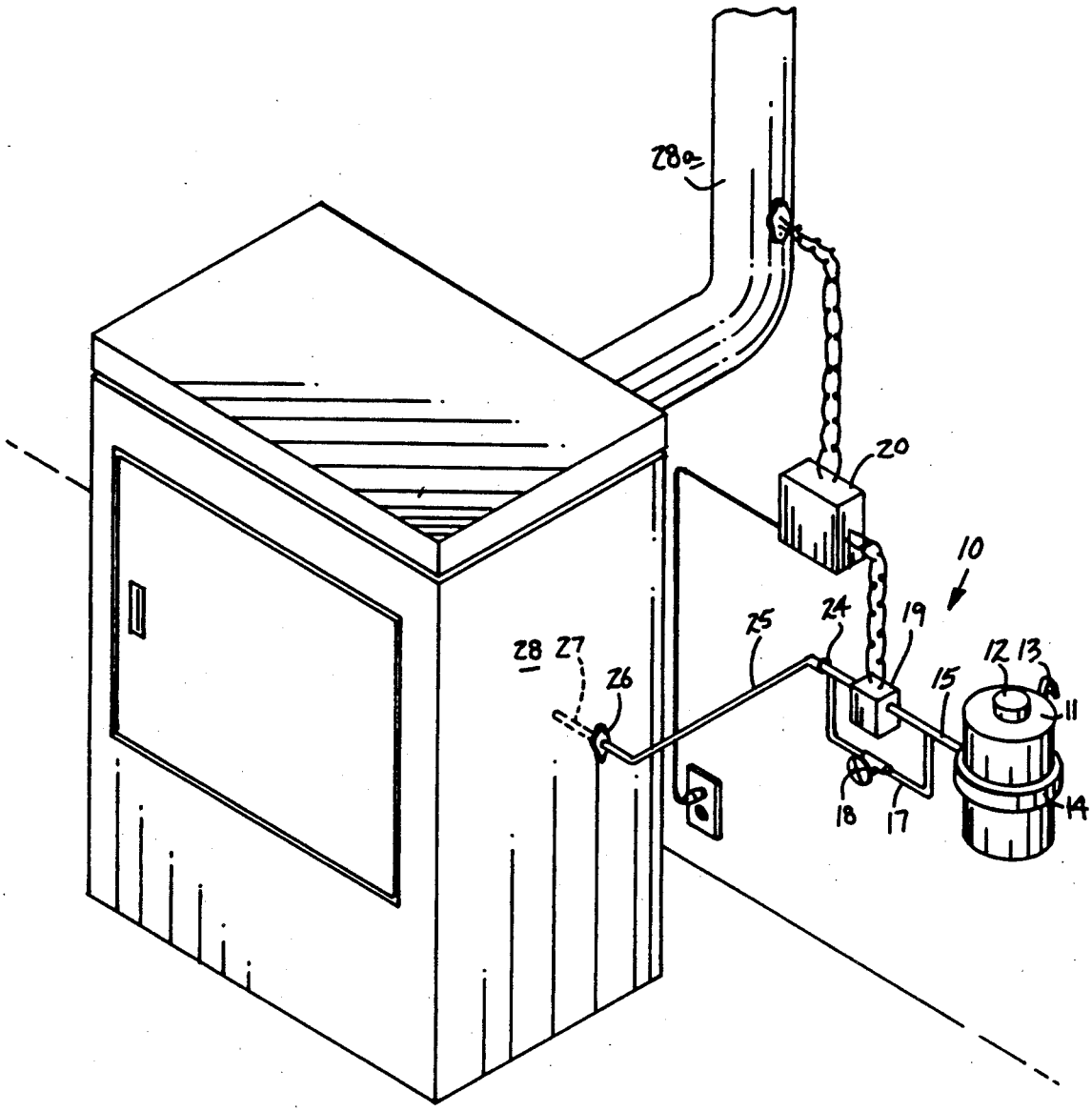
FIG. 3 is an isometric illustration of the invention positioned and secured in association with a firebox organization.

More specifically, the chimney fire extinguishing apparatus 10 essentially comprises a pressurized reservoir 11 including a removable lid 12 for replacement of the reservoir with a hanger 13 for securement of the reservoir onto a convenient support, wherein the hanger 13 is secured orthogonally relative to a girdle strap 14 secured about the reservoir 11 to minimize deflection of the reservoir in a suspended orientation by the hanger 13. It should be noted that the reservoir 11 may include an optional valve **11*a* to enable selective and repetitive pressurization of the reservoir 11 as desired in use. The reservoir 11 includes a first outlet hose 15 of either a rigid or flexible construction and arranged in operative association to a first junction 16. A by-pass conduit 17 enables flow to by-pass a solenoid 19, to be discussed in more detail below, by way of a manual by-pass valve 18 to enable directing of flow to the associated perforated spray hose 27, as illustrated in FIG. 2. The solenoid 19 is operatively associated through a relay junction box 20 that utilizes conventional house current of 110 voltage or a backup battery supply (not shown). A bi-metallic sensor 21 formed with a forward end 21*a* is positioned interiorly of a furnace flue 28*a* operatively associated with a furnace 28, whereupon elevated temperatures exceeding normal combustion temperatures by 150 degrees F. or more closes the bimetallic sensor switch 21 to actuate the solenoid 19 and enable flow of a fluid medium, such as water, through the first outlet hose 15, then through a second outlet hose 22 that is operatively connected to a hose coupling 24 connecting the second outlet hose 22 to a flexible hose 25. The flexible hose 25 is secured to a securement plate 26 that is secured to a furnace firebox 28. A perforated hose 27 is in fluid communication with a second flexible hose 25 through the securement plate 26 and enables a directing of the fluid extinguishing medium through the perforation of the hose 27 to cool and lower combustion temperatures within the firebox 28 and thereby extinguishing a chimney fire within the flue 28*a* as the source of the combustion temperature enables a combustion within the flue 28*a*** to be eliminated.

FIG. 4 illustrates a modified reservoir lid 29 securable to the reservoir 11 in lieu of the lid 12. The modified lid 29 includes a reciprocatable rod 30 reciprocatable through the lid 29 through a seal 31 to maintain pressure within the reservoir 11 with a float 32 secured to a lower terminal end of the rod 30. An "L" shaped arm 33 is formed at an upper end of the rod 30 with a first electrical contact 34 secured to an interior terminal end of the "L" shaped arm 33 that is aligned with a second electrical contact 35 secured to the modified lid 29. The electrical contacts 34 and 35 are in electrical communication to the buzzer 36 through a conventional electrical power supply, as illustrated in FIG. 5. Upon the fluid medium within a container 11 dropping due to its utilization to extinguish a flue fire as noted above, the "L" shaped arm 33 will descend upon the float 32 dropping within a lowered fluid supply to close and effect contact between the first and second respective electrical contacts 34 and 35 and thereby actuate the audible buzzer alarm 36.

FIG. 6 is illustrative of a modified delivery system utilizing an elongate delivery hose 38 formed with a "U" shaped forward end 39 that reorients a second delivery hose **38*a* in parrallel arrangement to the delivery hose 38 that through a rearwardly directed nozzle 40 will direct a flow of water or other suitable coolant medium against an interior wall surface of the furnace firebox 38 to thereby avoid extinguishing of a flame within the firebox 38** to enable continuous operation of the furnace.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A chimney fire extinguishing apparatus securable to a furnace firebox and associated chimney flue wherein the apparatus comprises, a fluid reservoir including a first outlet hose operatively associated to a solenoid valve, and a second outlet hose secured at one end to said solenoid valve and at its other end to a delivery hose, the delivery hose secured in fluid communication with a nozzle, the nozzle positioned interiorly of the furnace firebox, and a heat sensing switch means positioned within said flue for sensing elevated predetermined temperatures within said flue to energize said solenoid valve upon sensing of said predetermined temperatures to enable a directing of fluid from said reservoir to said nozzle assembly, and wherein said delivery hose is flexible to enable orientation of said delivery hose relative to said furnace firebox, and wherein said heat sensing switch comprises a bi-metallic switch member including a forward end positioned interiorly of said flue in electrical communication with said solenoid through an electrical junction box, and wherein said nozzle assembly includes a perforated nozzle positioned interiorly of said furnace firebox to direct a fluid spray interiorly of said firebox, and wherein said nozzle assembly includes a first elongate rigid hose directed interiorly of said firebox and terminating in a "U" shaped forward end, and a second rigid delivery hose arranged parallel to said first delivery hose and formed with a nozzle at its free end to direct a spray of fluid onto an interior surface of said firebox to effect cooling of said firebox, and wherein said audible alarm includes a reciprocable rod directed through a lid securable to said reservoir, a lower end of said rod including a float secured thereto and an upper end of said rod including an "L" shaped leg formed thereon, a first electrical contact formed upon a lower surface of said leg in aligment with a second contact integrally secured and directed upwardly of said lid, said first electrical contact mounted for electrical association with said second contact upon a reduced fluid level effected within said reservoir to actuate said alarm.

* * * * *